US009429977B2

(12) United States Patent
Farris et al.

(10) Patent No.: US 9,429,977 B2
(45) Date of Patent: Aug. 30, 2016

(54) RELIEF SPRING STOP BOLT ASSEMBLY FOR SHALLOW BOWL MILLS

(71) Applicant: ALSTOM Technology Ltd, Baden (CH)

(72) Inventors: Lawrence Scott Farris, East Granby, CT (US); Todd G. Williams, Ellington, CT (US)

(73) Assignee: ALSTOM TECHNOLOGY LTD, Baden (CH)

( * ) Notice: Subject to any disclaimer, the term of this patent is extended or adjusted under 35 U.S.C. 154(b) by 28 days.

(21) Appl. No.: 14/038,211

(22) Filed: Sep. 26, 2013

(65) Prior Publication Data

US 2014/0096640 A1 Apr. 10, 2014

Related U.S. Application Data

(60) Provisional application No. 61/710,406, filed on Oct. 5, 2012.

(51) Int. Cl.
*G05G 5/04* (2006.01)
*B02C 15/04* (2006.01)

(52) U.S. Cl.
CPC ..... *G05G 5/04* (2013.01); *B02C 15/04* (2013.01); *Y10T 29/49716* (2015.01); *Y10T 74/20636* (2015.01)

(58) Field of Classification Search
CPC ..... B02C 15/04; B02C 25/00; G05G 5/04; Y10T 74/20636; Y10T 29/49716
See application file for complete search history.

(56) References Cited

U.S. PATENT DOCUMENTS

| | | | | |
|---|---|---|---|---|
| 3,818,567 | A * | 6/1974 | Moro | 29/252 |
| 3,921,995 | A * | 11/1975 | Moog et al. | 280/618 |
| 4,432,500 | A * | 2/1984 | Brundiek et al. | 241/57 |
| 4,759,509 | A * | 7/1988 | Prairie | 241/121 |
| 2005/0263630 | A1 | 12/2005 | Zhang et al. | |
| 2010/0327094 | A1 | 12/2010 | Stone et al. | |

FOREIGN PATENT DOCUMENTS

| | | | |
|---|---|---|---|
| CN | 2589075 | Y | 12/2003 |
| CN | 2680354 | Y | 2/2005 |
| DE | 4325187 | A1 | 2/1994 |
| EP | 0056236 | A2 | 7/1982 |
| EP | 2246116 | A1 | 11/2010 |
| JP | S6320953 | U | 12/1988 |
| JP | H01-179744 | | 12/1989 |
| JP | 3330552 | B2 | 9/2002 |
| TW | 559924 | A | 11/2003 |
| WO | 2009/087558 | A1 | 7/2009 |

OTHER PUBLICATIONS

European Search Report dated Jan. 20, 2014 for EP Application No. 13187204.6.
Office action issued from Taiwanese Patent Office dated Apr. 28, 2015 for TW Application No. 102136082.
Office action issued from Chinese Patent Office dated Feb. 2, 2015 for CN Application No. 201310670871.X.
Office action issued from Korean Patent Office dated Feb. 6, 2015 for KR Application No. 10-2013-0118362.
Unofficial translation of Korean Notice of Allowance issued in connection with corresponding KR Application No. 10-2013-0118362 on Aug. 11, 2015.

* cited by examiner

*Primary Examiner* — Thomas Diaz
(74) *Attorney, Agent, or Firm* — GE Global Patent Operation; Stephen G. Midgley

(57) ABSTRACT

A relief spring stop bolt assembly for shallow bowl coal pulverizing mills and a method of using the same to smooth operation of such a pulverizer during low load operation is described. The subject relief spring stop bolt assembly is sized to be used with or for "retrofit" within existing journal space and existing journal opening cover space of a shallow bowl mill to effectively smooth rough operating conditions.

15 Claims, 3 Drawing Sheets

RELIEF SPRING STOP BOLT ASSEMBLY FOR SHALLOW BOWL MILLS

FIELD OF THE INVENTION

The present invention relates to solid fuel pulverizers, and more specifically, to a relief spring stop bolt assembly for shallow bowl coal pulverizing mills.

BACKGROUND OF THE INVENTION

Solid fossil fuels such as coal often are ground in order to render the solid fossil fuel suitable for certain applications. Grinding the solid fossil fuel can be accomplished using a device referred to by those skilled in the art as a pulverizer. One type of pulverizer suited for grinding is referred to as a "bowl mill pulverizer". This type of pulverizer obtains its name by virtue of the fact that the pulverization that takes place therein is effected on a grinding surface that in configuration bears a resemblance to a bowl. In general, a bowl mill pulverizer comprises a body portion on which a grinding table is mounted for rotation. Grinding rollers mounted on suitably supported journals interact with the grinding table to effect the grinding of material interposed therebetween. After being pulverized, the particles of material are thrown outwardly by centrifugal force, whereby the particles are fed into a stream of warm air and blown into other devices for separation by particle size.

Grinding rollers are urged toward the grinding table against the fossil fuel being ground by a spring assembly. The force that this exerts may be manually adjusted. The greater the force, the finer the particle size of the fossil fuels being ground.

Coal pulverizers operating under low load conditions when there isn't enough coal feed to develop a stable coal bed causes rough operation. Rough operation causes high bending stresses to be placed on a main vertical shaft of the pulverizer, which can result in its failure. These stresses are also high enough that many component failures have been attributed to such rough operation. Relief spring assemblies have been used in the past on deep bowl mills to reduce such stresses at times of rough operation. However, such spring, assembly arrangements are not possible on shallow bowl mills due to the very small space available working within existing journal and journal opening cover spaces.

It is important that any solution to this existing rough operation issue is capable of implementation within existing journal and journal opening cover spaces due to the expense of otherwise replacing such equipment. Accordingly, any solution must be able to be used with or "retrofitted" to fit within existing journal space and existing journal opening cover space of a shallow bowl mill.

SUMMARY OF THE INVENTION

The present invention is a relief spring stop bolt assembly for shallow bowl mills used in fossil fuel pulverization. The subject relief spring stop bolt assembly is used with or for "retrofit" within existing journal space and existing journal opening cover space of a shallow bowl mill. The relief spring stop bolt assembly is spring loaded to be solid under the full pivoting weight of the journal assembly, while providing approximately one quarter of an inch of travel to dampen or ease the journal assembly's downward travel as it comes down on the stop bolt. This spring load feature of the subject stop bolt assembly also assists the journal as it first starts to lift off the stop bolt. By easing the journal assembly's downward travel and assisting the journal as it first starts to lift off the stop bolt, the pulverizer's operation is smoothed out or less rough under low load conditions when there isn't enough fossil fuel, such as coal, feed to develop a stable fuel bed or coal bed.

The present relief spring stop bolt assembly, which works with existing commercial journals and journal opening covers, comprises an adjustable threaded stationary section. The adjustable threaded stationary section may be turned clockwise in or counterclockwise out to adjust the "ring to roll" distance or setting. The ring to roll setting dictates the distance between an associated grinding table and the journal roll when there is no fuel or coal in the mill. A nose section of the relief spring stop bolt assembly contacts the journal when there is no coal in the mill. The spring used in the assembly is either a coil spring or spring discs to allow the bolt to be solid under the gravity load of the journal assembly and to allow proper ring to roll setting without the risk of the spring flexing too much and allowing the journal to hit the grinding table. The spring portion of the assembly must also be strong enough to provide sufficient dampening or easing for loads over ten tons and sufficient spring assist for the journal in order to smooth out low load operation thereof. The selected spring must have a useful operating life in the millions of cycles.

The present relief spring stop bolt assembly likewise comprises a bolt bushing to provide protection to the assembly from dust and debris and to allow for lubrication of the stop bolt spring.

Accordingly, the present disclosure provides for a pulverizer stop bolt assembly comprising a stop bolt with a spring mechanism solidly immobile for adjustment to prevent a pulverizer journal assembly from contacting a grinding surface of the pulverizer upon bearing a gravity load of the journal assembly, and a spring in the spring mechanism strong enough to provide significant load dampening and ample spring assist to smooth out low load operation of a shallow bowl mill-type pulverizer.

The present disclosure also provides a method of smoothing pulverizer operation during low load use comprising fixing to a pulverizer housing a stop bolt with a spring mechanism solidly immobile for adjustment to prevent a pulverizer journal assembly from contacting a grinding surface of the pulverizer upon bearing a gravity load of the journal assembly, and using a spring in the spring mechanism strong enough to provide significant load dampening and ample spring assist to smooth out low load operation of a shallow bowl mill-type pulverizer.

Likewise, the present disclosure provides a method of replacing a pulverizer stop bolt assembly for smoother operation during low load use comprising removing screws from a stop bolt assembly, removing the stop bolt assembly from a pulverizer housing, inserting a relief spring stop bolt assembly into the pulverizer housing, and tightening screws to fix the relief spring stop bolt assembly to the pulverizer housing.

DETAILED DESCRIPTION OF THE INVENTION

Figure 1:
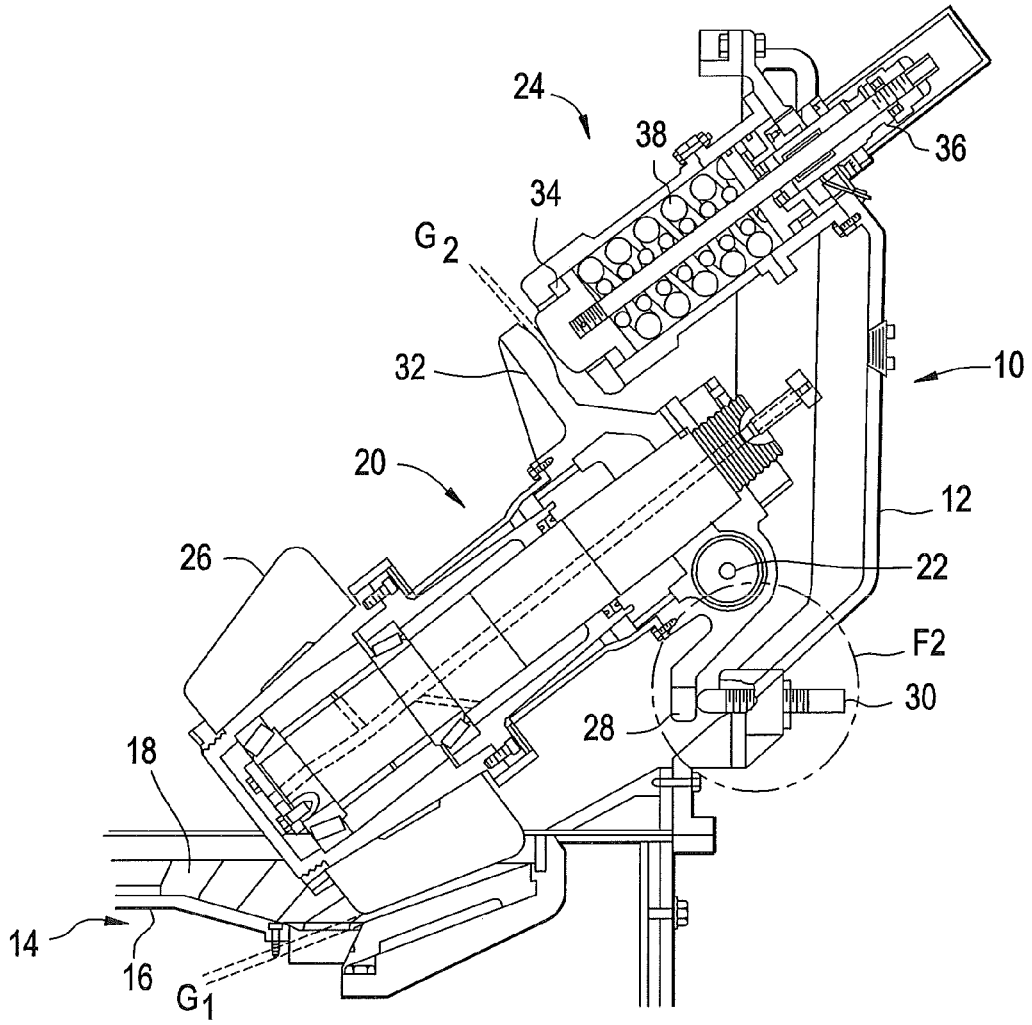
FIG. 1 is a schematic, partial, side cross-sectional view of a pulverizer including a prior art stop bolt assembly.

Referring now to FIG. 1, is a shallow bowl mill-type pulverizer 10 that includes a pulverizer housing 12 with an interior area 14 having a grinding table 16 situated therein. Grinding table 16 provides a grinding surface 18 for a material, such as a fossil fuel, such as coal, to be pulverized. In one embodiment, the grinding table 16 is mounted on a shaft (not shown) operatively connected to a gearbox drive mechanism (not shown) so as to be capable of driven rotation within the pulverizer housing 12. A journal assembly 20 is pivotally mounted on a pivot shaft 22 that is secured to the pulverizer housing 12. For ease of illustration, only one journal assembly 20 and associated spring assembly 24 are shown and described, but the invention is not limited in this regard, and in other embodiments, the pulverizer 10 may comprise two, three, or more journal assemblies 20 and associated pressure spring assemblies 24, which may be evenly distributed about the grinding surface 18.

The journal assembly 20 carries a grinding roll 26 rotatably mounted thereon and positions the grinding roll to define a gap G1 between the grinding roll 26 and the grinding surface 18. The gap G1 varies when the journal assembly 20 pivots on the pivot shaft 22. The journal assembly 20 includes a journal stop flange 28 and an associated stop bolt 30 in the pulverizer housing 12 to limit the pivoting motion of the journal assembly 20 toward the grinding surface 18, thus setting a minimum size for the gap G1. As known in the art, selecting the minimum size for gap G1 contributes to determining the particle size distribution of the pulverized material produced in the pulverizer 10.

The journal assembly 20 also includes a journal head 32, and the journal assembly 20 and the spring assembly 24 are mounted on the pulverizer housing 12 so that the journal head 32 can engage the spring seat 34 when the journal assembly 20 pivots away from the grinding surface 18, e.g., in response to the introduction of granule material between the grinding surface 18 and the grinding roll 26. Optionally, the journal assembly 20 and the spring assembly 24 may be configured so that there is a gap G2 between the journal head 32 and the spring seat 34. The gap G2 is at a maximum when the journal assembly pivots fully forward, i.e., when the gap G1 is at a minimum. The maximum gap G2 can be adjusted by advancing or retracting the support bolt 36 of spring assembly 24. When the journal assembly 20 pivots sufficiently to close the gap G2, the journal head 32 engages the spring seat 34 and the spring assembly 24 imposes a spring force upon the journal head 32. The journal assembly 20 then conveys the spring force onto the granule material to be pulverized via the grinding roll 26. The more that the granule material causes the journal assembly 20 to pivot away from the grinding surface 18, the more the springs 38 of spring assembly 24 are compressed and the greater the spring force that is imposed on the journal head 32.

Figure 2:
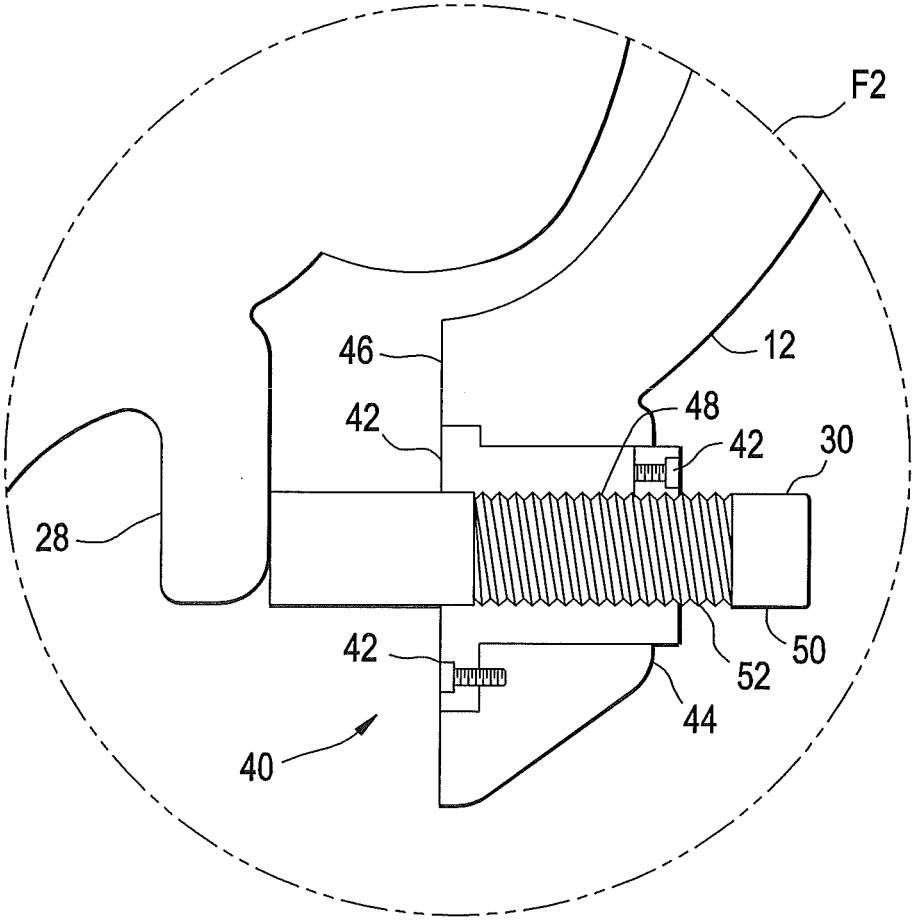
FIG. 2 is a schematic, enlarged side cross-sectional view of the prior art stop bolt assembly of FIG. 1.

As noted previously, the journal assembly 20 includes a journal stop flange 28 and an associated stop bolt 30 in the pulverizer housing 12 to limit the pivoting motion of the journal assembly 20 toward the grinding surface 18, thus setting a minimum size for the gap G1. As best illustrated in FIG. 2 is an enlarged, detailed illustration of the stop flange 28 and associated prior art stop bolt 30 of FIG. 1. Stop bolt 30 is one component of the prior art stop bolt assembly 40. Stop bolt assembly 40 includes a housing 42 positioned in the pulverizer housing 12 and fixed into place with threaded screws 42. Stop bolt 30 extends from exterior surface 44 of pulverizer housing 12 and from interior surface 46 of pulverizer housing 12 through a channel 48 formed through housing 42. A portion of exterior surface 50 of stop bolt 30 has threading 52 for fixed positioning of stop bolt 30 within housing 42 thereby setting gap G1.

Figure 3:
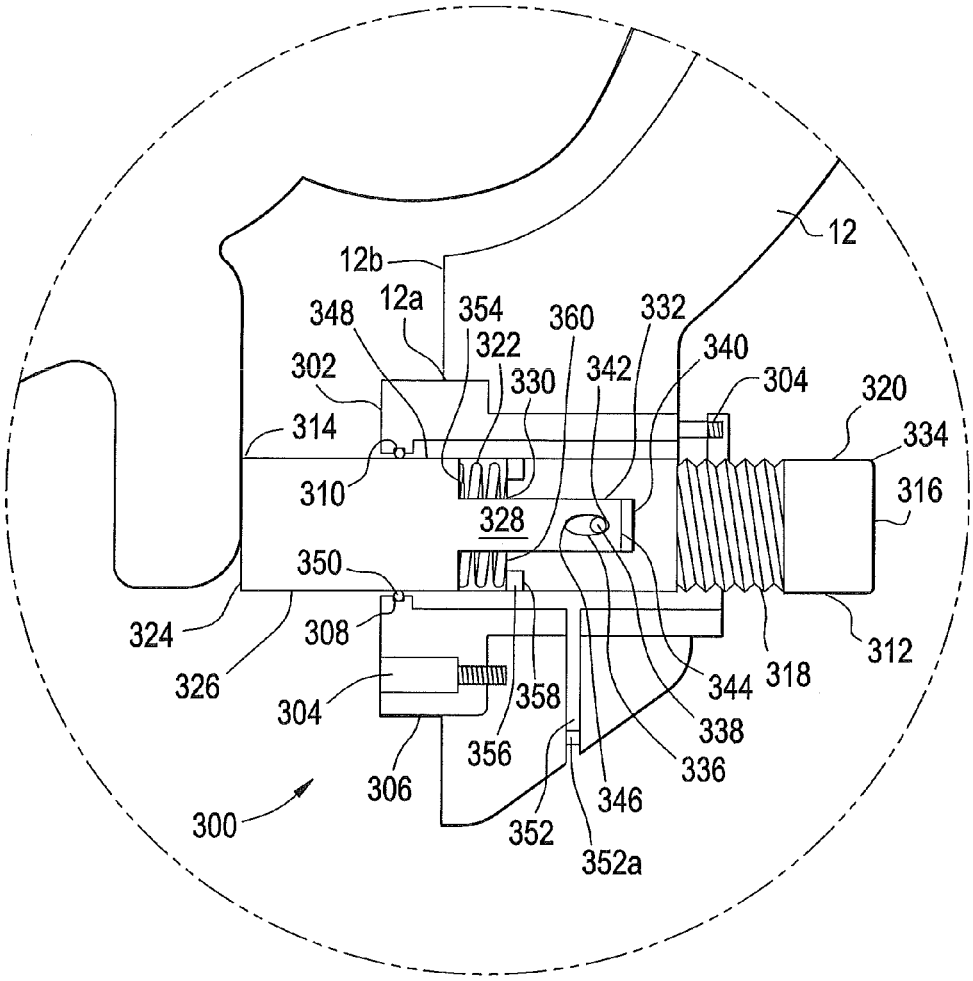
FIG. 3 is a schematic, enlarged side cross-sectional view of the journal stop bolt assembly of the present disclosure.

Illustrated in FIG. 3 is the subject relief spring stop bolt assembly 300 of the present disclosure. Relief spring stop bolt assembly 300 is sized to readily replace stop bolt assembly 40 illustrated in FIG. 2. As such, stop bolt assembly 40 is removed from pulverizer housing 12 by counter-clockwise rotation of threaded screws 42 for removal thereof. Upon removal of threaded screws 42, housing 42 is removed from an interior seating area 12*a* in pulverizer housing 12. Once housing 42 is removed from interior seating area 12*a* in pulverizer housing 12, relief spring stop bolt assembly 300 is placed in interior seating area 12*a* in pulverizer housing 12. Accordingly, the subject relief spring stop bolt assembly 300 may be installed in a new pulverizer housing 12 as new equipment or may be installed as just described in a used pulverizer housing 12 as a "retrofit" to replace stop bolt assembly 40.

As illustrated in FIG. 3, relief spring stop bolt assembly 300 comprises a housing 302 that comprises fixative screws 304, an elongated head portion 306, an O-ring channel 308, and an O-ring 310. Relief spring stop bolt assembly 300 also comprises stop bolt 312 with nose surface 314 opposite an adjustment end 316. Proximal to adjustment end 316 is threaded area 318 on exterior surface 320 of stop bolt 312. Between nose surface 314 and adjustment end 316 is spring 322. Spring 322 comprises either a coil spring or spring discs selected to allow the stop bolt 312 to go solid under the gravity load of the journal assembly 20 to allow proper ring to roll adjustment without the risk of the spring 322 flexing too much and allowing the journal assembly 20 to hit the grinding surface 18. At the same time, the spring 322 must be strong enough to provide significant dampening and ample spring assist to smooth out low load operation of the pulverizer 10. Due to extreme size limitations, strength requirements and durability requirements, spring 322 preferably comprises a disc spring, such as a Belleville disc spring.

As noted above, stop bolt 312 goes solid under the gravity load of the journal assembly 20 to allow proper ring to roll adjustment without the risk of the spring 322 flexing too much and allowing the journal assembly 20 to hit the grinding surface 18. To accomplish these requirements, stop bolt 312 has a number of specialized features. Nose surface 314 forms free end 324 of contact portion 326. Contact portion 326 includes opposite nose surface 314, an elongated arm 328. Elongated arm 328 of contact portion 326 extends through a center area 330 of spring 322 for positioning within a slot 332 of base portion 334. Elongated arm 328 has an oversized aperture 336 therethrough. A pin member 338 extends through oversized aperture 336 into base portion 334 to moveably interlock contact portion 326 to base portion 334. When no weight is on contact portion 326, spring 322 holds elongated arm 328 away from bottom 340 of slot 332 so pin member 338 is in contact with a base side 342 of oversized aperture 336. When the journal assembly 20 comes to rest on nose surface 314 of contact portion 326, stop bolt 312 goes solid by free end 344 of elongated arm 328 abutting bottom 340 of slot 332 so pin member 338 is in contact with a nose side 346 of oversized aperture 336. Also under such conditions, spring 322 is compressed between wall 354 of contact portion 326 and a hardened thrust washer 356 in groove 358 on free ends 360 of base portion 334. As the weight of journal assembly 20 moves from stop bolt 312, spring 322 provides ample spring force assist to smooth out low load operation of the pulverizer 10. The spring force assist of spring 322 moves elongated arm 328 of contact portion 326 away from bottom 340 of slot 332 so pin member 338 is again in contact with base side 342 of oversized aperture 336. According to the mechanism just described, the stop bolt 312 goes solid under the gravity load of the journal assembly 20 to allow proper ring to roll adjustment without the risk of the spring 322 flexing too much and allowing the journal assembly 20 to hit the grinding surface 18. At the same time, spring 322 is strong enough to provide significant dampening and ample spring assist to smooth out low load operation of the pulverizer 10. At the same time, the subject relief spring stop bolt assembly 300 meets the extreme size limitations, strength requirements and durability requirements, for use or retrofit with shallow bowl mill-type pulverizers 10.

As noted above, relief spring stop bolt assembly 300 comprises a housing 302 that comprises fixative screws 304, an elongated head portion 306, an O-ring channel 308, and an O-ring 310. Elongated head portion 306 extends a distance beyond surface 12*b* of pulverizer housing 12 so as to accommodate movement of stop bolt 312 by spring 322 therein, O-ring channel 308, and an O-ring 310. O-ring 310 abuts side 348 of contact portion 326 of stop bolt 312 to form a seal 350 therearound. Seal 350 serves to keep dust, dirt and debris away from the mechanical features of stop bolt 312 and serves to maintain a lubricant or grease on spring 322. A grease port 352 with closure cap 352*a* may be provided through pulverizer housing 12 into housing 302 for lubricant supply and maintenance.

A method of smoothing shallow bowl mill-type pulverizer 10 operation during low load use comprises using a relief spring stop bolt assembly 300 that is solid under a gravity load of journal assembly 20 and provides spring assist upon a change in the gravity load. As such, the subject relief spring stop bolt assembly 300 allows for proper ring to roll adjustment without the risk of the spring 322 flexing too much to allow the journal assembly 20 to hit the grinding surface 18. At the same time, the relief spring stop bolt assembly 300, with spring 322, is strong enough to provide significant dampening and ample spring assist to smooth out low load operation of the shallow bowl mill-type pulverizer 10.

A method of replacing a pulverizer stop bolt assembly for smoother operation during low load use comprises removing screws 42 from stop bolt assembly 40, removing stop bolt assembly 40 from pulverizer housing 12, inserting the subject relief spring stop bolt assembly 300 into pulverizer housing 12 and tightening screws 304 into pulverizer housing 12.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A pulverizer stop bolt assembly for a pulverizer, the pulverizer stop bolt assembly comprising:

a stop bolt that includes a base portion and a contact portion that has a free end and an elongated arm, the elongated arm includes an oversized aperture and is disposed opposite the free end, a portion of the elongated arm is positioned in a slot of the base portion such that the base portion is moveably interlocked with the contact portion via a pin that extends through the oversized aperture and into the base portion;

a spring disposed between the base portion and the contact portion; and wherein compression of the spring between the contact portion and the base portion prevents a journal assembly of the pulverizer from contacting a grinding surface of the pulverizer upon bearing a gravity load of the journal assembly, and the spring provides load dampening and spring assist to smooth load operation of the pulverizer when not bearing the gravity load of the journal assembly.

2. The pulverizer stop bolt assembly according to claim 1, wherein the spring is a coil spring.

3. The pulverizer stop bolt assembly according to claim 1, wherein the pulverizer is of a shallow bowl mill-type and the assembly is configured to be retrofitted into a housing of the pulverizer.

4. The pulverizer stop bolt assembly according to claim 1, wherein the spring of the pulverizer stop bolt assembly is compressed between a wall of the contact portion and a hardened thrust washer on a free end of the base portion.

5. The pulverizer stop bolt assembly according to claim 1, wherein the assembly includes a grease port for spring lubricant supply and maintenance.

6. A method of smoothing operation of a pulverizer during low load use, the method comprising:

fixing to a housing of the pulverizer a stop bolt assembly with a spring mechanism therein, the stop bolt assembly with spring mechanism including a stop bolt that includes a base portion and a contact portion that has a free end and an elongated arm, the elongated arm includes an oversized aperture and is disposed opposite the free end, a portion of the elongated arm is positioned in a slot of the base portion such that the base portion is moveably interlocked with the contact portion via a pin that extends through the oversized aperture and into the base portion; and a spring disposed between the base portion and the contact portion; and using the spring in the stop bolt assembly with the spring mechanism to provide load dampening and spring assist to smooth low load operation of the pulverizer.

7. The method according to claim 6, wherein the spring is a coil spring.

8. The method according to claim 6, wherein the pulverizer is of a shallow bowl mill-type and the stop bolt assembly with the spring mechanism is configured to be retrofitted into a housing of the pulverizer.

9. The method according to claim 6, wherein the spring within the stop bolt assembly with the spring mechanism is compressed between a wall of the contact portion and a hardened thrust washer on a free end of the base portion.

10. The method according to claim 6, wherein the stop bolt assembly with the spring mechanism is fluidly connected to a grease port for spring lubricant supply and maintenance.

11. A method of replacing a pulverizer stop bolt in a housing of a pulverizer with a stop bolt assembly having a spring mechanism for smoother operation during low load use, the method comprising:

removing screws from the pulverizer stop bolt and the housing;

removing the pulverizer stop bolt from the housing;

inserting the stop bolt assembly having the spring mechanism into the pulverizer housing; and tightening screws to fix the stop bolt assembly having the spring mechanism to the housing;

wherein the stop bolt assembly having the spring mechanism includes a stop bolt that includes a base portion and a contact portion that has a free end and an elongated arm, the elongated arm includes an oversized aperture and is disposed opposite the free end, a portion of the elongated arm is positioned in a slot of the base portion such that the base portion is moveably interlocked with the contact portion via a pin that extends through the oversized aperture and into the base portion; and a spring disposed between the base portion and the contact portion.

12. The method according to claim 11, wherein the spring is a coil spring.

13. The method according to claim 11, wherein the pulverizer is of a shallow bowl mill-type and the stop bolt assembly having the spring mechanism is configured to be retrofitted into the housing.

14. The method according to claim 11, wherein the spring is compressed between a wall of the contact portion and a hardened thrust washer on a free end of the base portion upon bearing a gravity load of a pulverizer journal assembly of the pulverizer.

15. The method according to claim 11, wherein the stop bolt assembly having the spring mechanism is fluidly connected to a grease port for spring lubricant supply and maintenance.

* * * * *